US007265493B2

(12) United States Patent
Sommerer et al.

(10) Patent No.: US 7,265,493 B2
(45) Date of Patent: Sep. 4, 2007

(54) MERCURY-FREE COMPOSITIONS AND RADIATION SOURCES INCORPORATING SAME

(75) Inventors: Timothy John Sommerer, Ballston Spa, NY (US); Joseph Darryl Michael, Schoharie, NY (US); David John Smith, Clifton Park, NY (US); Vikas Midha, Clifton Park, NY (US); George Michael Cotzas, Saratoga Springs, NY (US)

(73) Assignee: General Electric Company, Niskayuna, NY (US)

( * ) Notice: Subject to any disclaimer, the term of this patent is extended or adjusted under 35 U.S.C. 154(b) by 253 days.

(21) Appl. No.: 10/957,893

(22) Filed: Oct. 4, 2004

(65) Prior Publication Data

US 2006/0071602 A1 Apr. 6, 2006

(51) Int. Cl.
*H01J 61/00* (2006.01)
*H01J 17/20* (2006.01)

(52) U.S. Cl. ..... 313/638; 313/25; 313/640; 313/643

(58) Field of Classification Search ..... 313/638–642, 313/25, 570, 571; 315/82
See application file for complete search history.

(56) References Cited

U.S. PATENT DOCUMENTS 3,778,662 A * 12/1973 Johnson ..... 313/490
4,001,626 A 1/1977 Drop et al.
4,360,756 A 11/1982 Spencer et al.
4,387,319 A 6/1983 White et al.
4,439,711 A 3/1984 Murakami et al.
4,492,898 A * 1/1985 Lapatovich et al. ..... 315/248
4,924,142 A 5/1990 Kaldenhoven
5,192,891 A 3/1993 Matsuura et al.
5,481,159 A 1/1996 Hiramoto et al.
6,137,230 A 10/2000 Born et al.
6,469,446 B1 10/2002 Stockwald
6,603,267 B2 8/2003 Hilbig et al.
6,756,721 B2 6/2004 Higashi et al.
6,853,140 B2 * 2/2005 Lapatovich et al. ..... 313/637
2002/0047525 A1 4/2002 Scholl et al.
2003/0001505 A1 1/2003 Scholl et al.

FOREIGN PATENT DOCUMENTS

JP 2003142029 5/2003
WO WO2005/117064 12/2005

OTHER PUBLICATIONS

PCT Search Report, PCT/US2005/034916, Mar. 10, 2005.

* cited by examiner

*Primary Examiner*—Joseph Williams
(74) *Attorney, Agent, or Firm*—Jason K. Klindtworth; Jean K. Testa

(57) ABSTRACT

A radiation source with an ionizable mercury-free composition. The ionizable composition including at least zinc or at least one zinc compound or both.

20 Claims, 4 Drawing Sheets

MERCURY-FREE COMPOSITIONS AND RADIATION SOURCES INCORPORATING SAME

BACKGROUND

The present invention relates generally to a mercury-free composition capable of emitting radiation if excited. In particular, the invention relates to a radiation source comprising an ionizable composition being capable of emitting radiation if excited.

Ionizable compositions are used in discharge sources. In a discharge radiation source, radiation is produced by an electric discharge in a medium. The discharge medium is usually in the gas or vapor phase and is preferably contained in a housing capable of transmitting the radiation generated out of the housing. The discharge medium is usually ionized by applying an electric field created by applying a voltage across a pair of electrodes placed across the medium. Radiation generation occurs in gaseous discharges when energetic charged particles, such as electrons and ions, collide with gas atoms or molecules in the discharge medium, causing atoms and molecules to be ionized or excited. A significant part of the excitation energy is converted to radiation when these atoms and molecules relax to a lower energy state, and in the process emit the radiation.

Gas discharge radiation sources are available and operate in a range of internal pressures. At one end of the pressure range, the chemical species responsible for the emission is present in very small quantities, generating a pressure during operation of a few hundreds pascals or less. The radiating chemical species may sometimes constitute as little as 0.1% of the total pressure.

Gas discharge radiation sources having a total operating pressure at the low end of the pressure range and radiating at least partly in the UV spectrum range, that include coatings of phosphors, can convert UV radiation to visible radiation, and are often referred to as fluorescent sources. The color properties of fluorescent sources are determined by the phosphors used to coat the tube. A mixture of phosphors is usually used to produce a desired color appearance.

Other gas discharge sources, including high intensity discharge sources, operate at relatively higher pressures (from about 0.05 MPa to about 20 MPa) and relatively high temperatures (higher than about 600° C.). These discharge sources usually contain an inner arc tube enclosed within an outer envelope.

Many commonly used discharge radiation sources contain mercury as a component of the ionizable composition. Disposal of such mercury-containing radiation sources is potentially harmful to the environment. Therefore, it is desirable to provide mercury-free discharge compositions capable of emitting radiation, which can be used in radiation sources.

SUMMARY OF INVENTION

In general, the present invention provides ionizable mercury-free compositions that are capable of emitting radiation when excited and radiation sources that incorporate one of such compositions.

In one aspect of the present invention, the ionizable mercury-free composition comprises at least zinc. The vapor pressure of zinc in the radiation source during its operation is less than about $1\times10^3$ Pa.

In another aspect, the present invention provides a radiation source that includes an ionizable mercury-free composition that comprises zinc and at least one zinc compound. The zinc compound is selected from the group consisting of halides, oxide, chalcogenides, hydroxide, hydride, organometallic compounds, and combinations thereof.

In still another aspect of the present invention, a radiation source includes an ionizable mercury-free composition that comprises at least a zinc compound. The zinc compound is selected from the group consisting of halides, oxide, chalcogenides, hydroxide, hydride, organometallic compounds, and combinations thereof. The vapor pressure of the zinc compound during operation of the radiation source is less than about $1\times10^3$ Pa.

BRIED DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
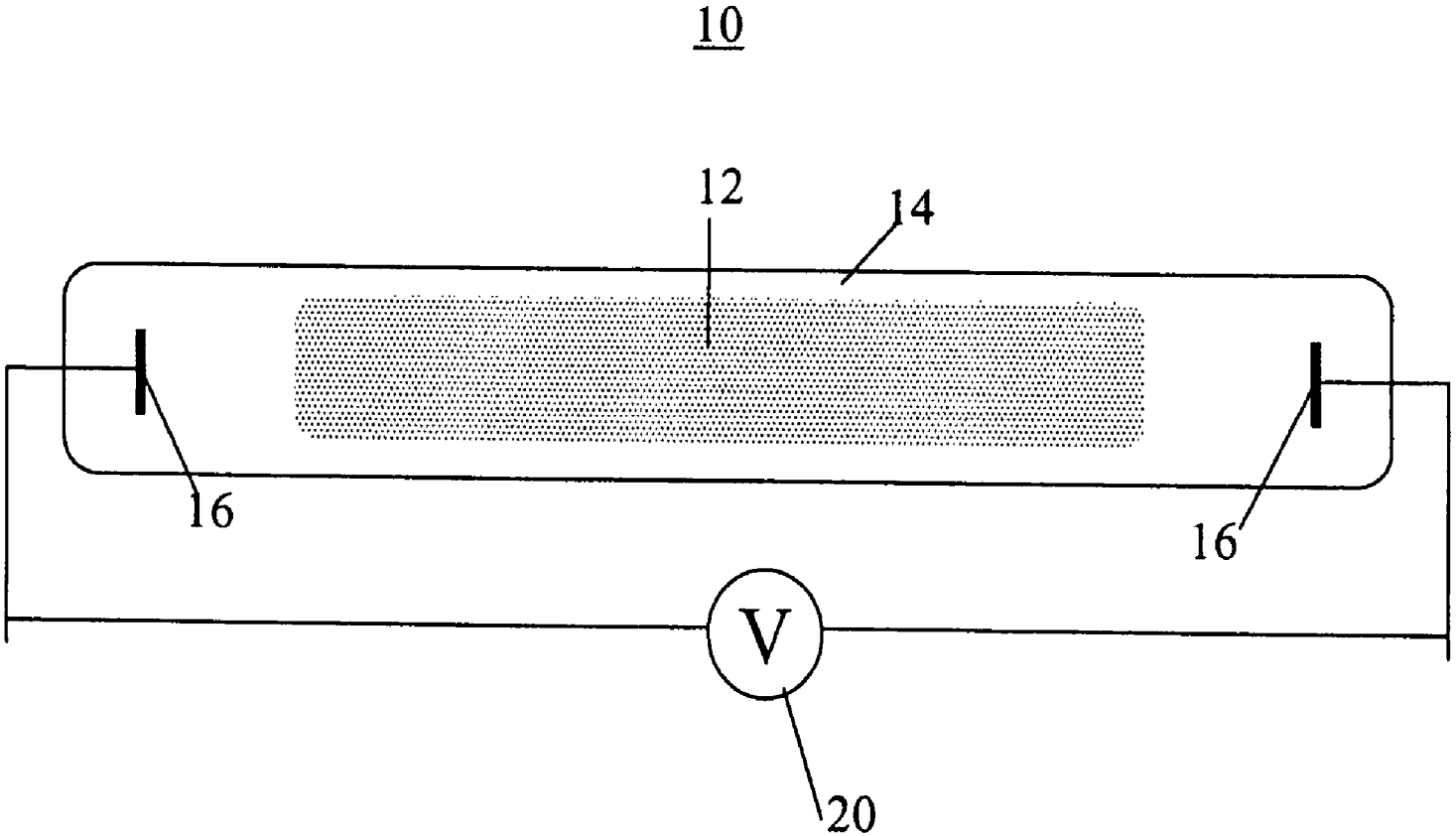
FIG. 1 is a radiation source in one embodiment of the present invention.

In an embodiment of the present invention, an ionizable mercury-free composition of a radiation source that comprises zinc in an amount such that a vapor pressure of zinc during an operation of the radiation source is less than about $1\times10^3$ Pa. The vapor pressure of zinc during operation is preferably less than about 100 Pa and, more preferably, less than about 10 Pa.

In one embodiment, zinc is present as zinc metal in an unexcited state. In another embodiment zinc is present as a component of an alloy with at least another metal other than mercury.

In another embodiment of the present invention, a radiation source comprises an ionizable mercury-free composition that comprises zinc and at least a zinc compound, which is selected from the group consisting of halides, oxide, chalcogenides, hydroxide, hydride, organometallic compounds, and combinations thereof.

In a further embodiment of the present invention, a radiation source comprises an ionizable mercury-free ionizable composition that comprises at least a zinc compound, which is selected from the group consisting of halides, oxide, chalcogenides, hydroxide, hydride, organometallic compounds, and combinations thereof. Said at least a zinc compound being present in an amount such that a vapor pressure of said at least a zinc compound during an operation of the radiation source is less than about $1\times10^3$ Pa, preferably, less than about 100 Pa, and more preferably, less than about 10 Pa.

In one aspect of the present invention, the ionizable composition in the radiation source is a zinc halide. In another aspect, the zinc halide is zinc iodide. In still another aspect, the zinc halide is zinc bromide.

The ionizable mercury-free composition further comprises an inert gas selected from the group consisting of helium, neon, argon, krypton, xenon, and combinations thereof. The inert gas enables the gas discharge to be more readily ignited. The inert gas, which serves as a buffer gas, also controls the steady state operation, and is used to optimize the lamp. In a non-limiting example, argon is used as the buffer gas. Argon may be substituted, either completely or partly, with another inert gas, such as helium, neon, krypton, xenon, or combinations thereof.

In one aspect of the invention, the gas pressure of the inert gas at the operating temperature is in the range from about 1 Pascal to about $1\times10^4$ Pa, preferably from about 100 Pa to about $1\times10^3$ Pa.

Within the scope of this invention, the efficiency of the radiation source may be improved by including two or more zinc compounds in the ionizable composition. The efficiency may be further improved by optimizing the internal pressure of the discharge during operation. Such optimization can be effected by controlling the partial pressure of zinc and/or zinc compounds, or by controlling the pressure of the inert gas, or by controlling the partial pressure of zinc and/or zinc compounds and the pressure of the inert gas. Moreover, the applicants have discovered that an increase in the luminous efficacy can be achieved by controlling the operating temperature of the discharge. The luminous efficacy, expressed in lumen/Watt, is the ratio between the brightness of the radiation in a specific visible wavelength range and the energy for generating the radiation.

FIG. 1 schematically illustrates a gas discharge radiation source 10. FIG. 1 shows a tubular housing or vessel 14 containing an ionizable composition of the present invention. The material comprising the housing 14 may be transparent or opaque. The housing 14 may have a circular or non-circular cross section, and need not be straight. In one embodiment, the discharge is desirably excited by thermionically emitting electrodes 16 connected to a voltage source 20. The discharge may also be generated by other methods of exitation that provide energy to the composition. It is within the scope of this invention that various waveforms of voltage and current, including alternating or direct, are contemplated for the present invention. It is also within the scope of this invention that additional voltage sources may also be present to help maintain the electrodes at a temperature sufficient for thermionic emission of electrons.

Figure 2:
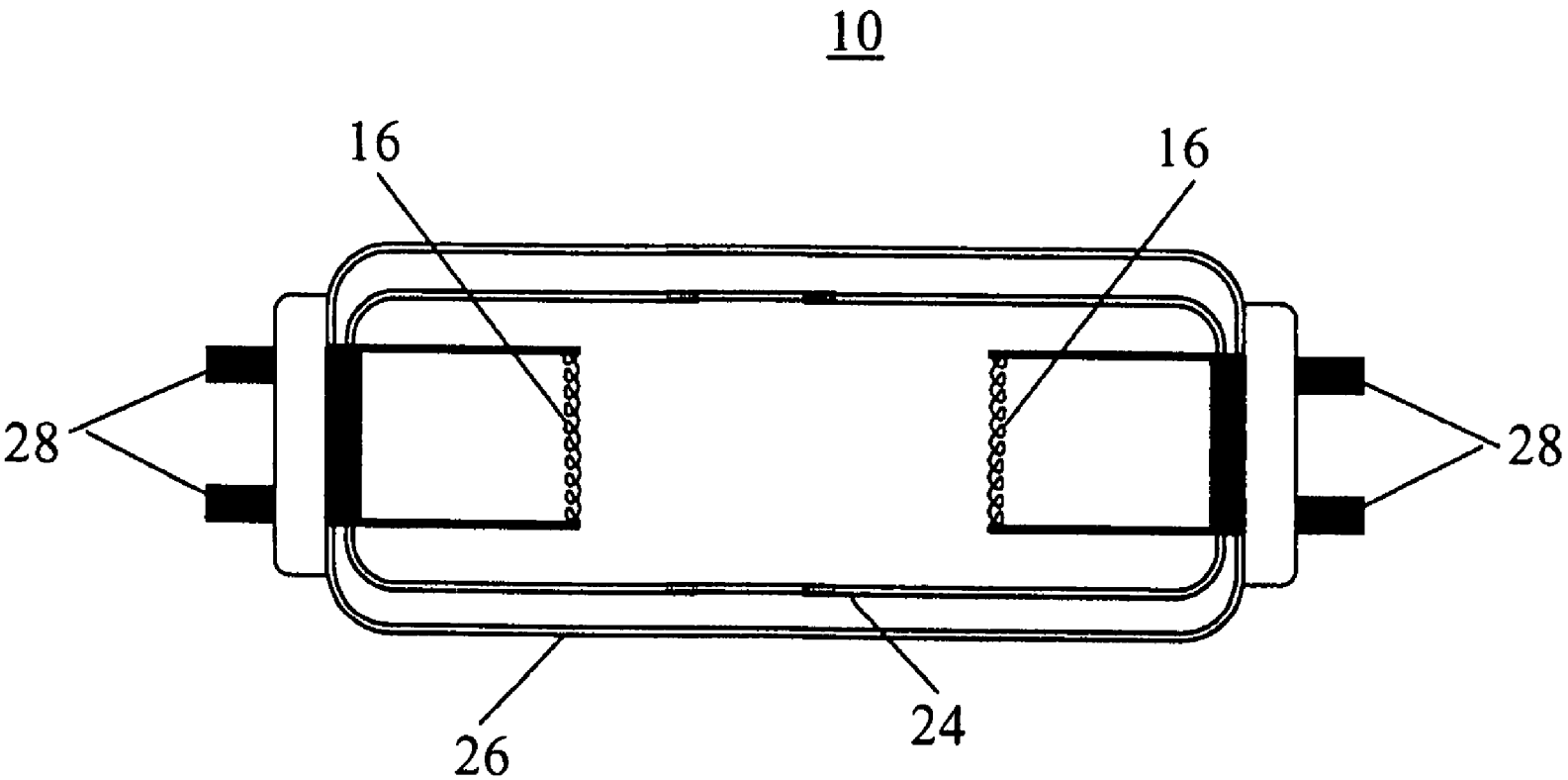
FIG. 2 is a radiation source in a second embodiment of the present invention.

FIG. 2 schematically illustrates another embodiment of a gas discharge radiation source 10. The housing comprises an inner envelope 24 and an outer envelope 26. The space between the two envelopes is either evacuated or filled with a gas.

Figure 3:
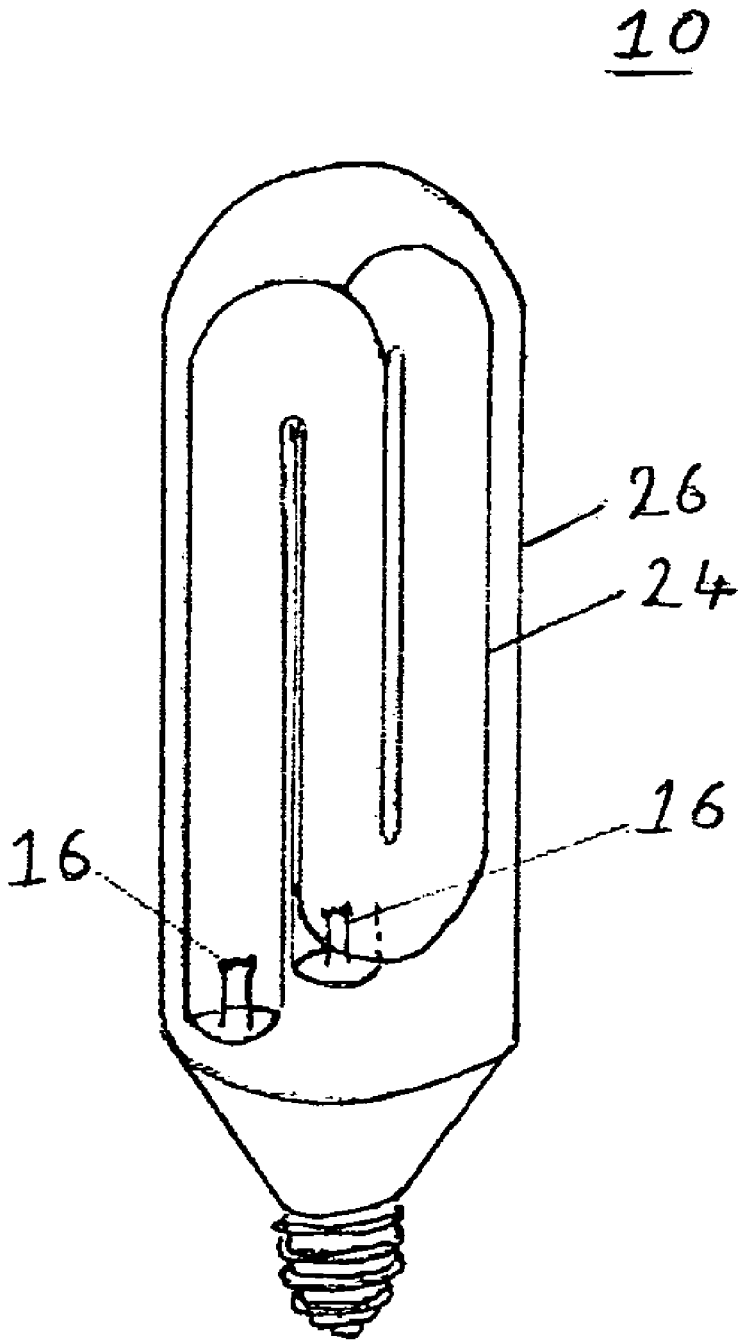
FIG. 3 is a radiation source in a third embodiment of the radiation source of the present invention.

The gas discharge radiation source housing may alternatively be embodied so as to be a multiple-bent tube or inner envelope 24 surrounded by an outer envelope or bulb 26 as shown in FIG. 3.

The housing or the envelope of the radiation source containing the ionizable composition is preferably made of a material type that is substantially transparent. The term "substantially transparent" means allowing a total transmission of at least about 50 percent, preferably at least about 75 percent, and more preferably at least 90 percent, of the incident radiation within 10 degrees of a perpendicular to a tangent drawn at any point on the surface of the housing or envelope.

Within the scope of this invention, phosphors may be used to absorb the radiation emitted by the discharge and emit other radiation in the visible wavelength region. In one embodiment, a phosphor or a combination of phosphors may be applied to the inside of the radiation source envelope. Alternatively, the phosphor or phosphor combination may be applied to the outside of the radiation source envelope provided that the envelope is not made of any material that absorbs a significant amount of the radiation emitted by the discharge. A suitable material for this embodiment is quartz, which absorbs little radiation in the UV spectrum range.

In one embodiment of the radiation source, wherein the housing containing the ionizable composition has an inner envelope and an outer envelope; the phosphors may be coated on the outer surface of the inner envelope and/or the inner surface of the outer envelope.

The chemical composition of the phosphor determines the spectrum of the radiation emitted. The materials that can suitably be used as phosphors absorb at least a portion of the radiation generated by the discharge and emit radiation in another suitable wavelength range. For example, the phosphors absorb radiation in the UV range and emit in the visible wavelength range, such as in the red, blue and green wavelength range, and enable a high fluorescence quantum yield to be achieved.

Figure 4:
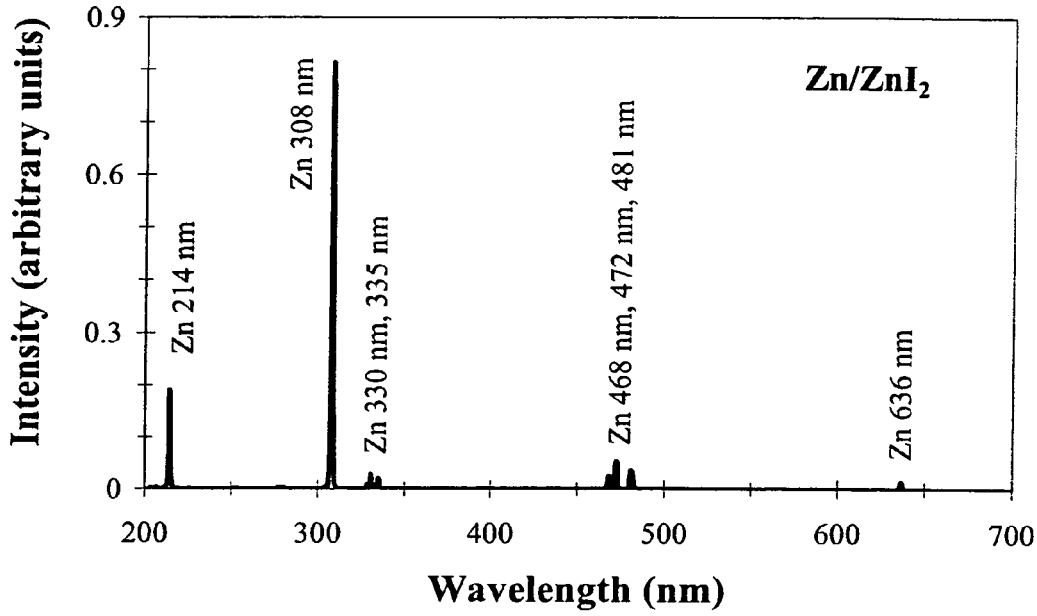
FIG. 4 is an emission spectrum of a radiation source in one embodiment of the present invention.

In a non-limiting example, for a gas discharge radiation source containing zinc and zinc iodide, where the radiation output is dominated by the spectral transitions at about 214 nanometers and at about 308 nanometers, as shown in FIG. 4, phosphors that convert radiation at, at least one of these wavelengths, is used.

Within the scope of this invention, non-limiting examples of phosphors which may be used for the generation of light in the blue wavelength range are SECA/BECA; SPP:Eu; Sr(P,B)O:Eu; $Ba_3MgSi_2O_8$:Eu; $BaAl_8O_{13}$:Eu; $BaMg_2Al_{16}O_{27}$:Eu; $BaMg_2Al_{16}O_{27}$:Eu,Mn; $Sr_4Al_{14}O_{25}$:Eu; (Ba,Sr)$MgAl_{10}O_{17}$:Eu; $Sr_4Si_3O_8Cl_2$:Eu; $MgWO_4$; $MgGa_2O_4$:Mn;$YVO_4$:Dy; $(Sr,Mg)_3(PO_4)_2$:Cu, (Sr,Ba) $Al_2Si_2O_8$:Eu; ZnS:Ag; Ba5SiO4Cl6:Eu, and mixtures thereof.

Within the scope of this invention, non-limiting examples of phosphors which may be used for the generation of light in the green wavelength range are $Zn_2SiO_4$:Mn; $Y_2SiO_5$:Ce, Tb; $YAlO_3$:Ce,Tb; $(Y,Gd)_3(Al,Ga)_5O_{12}$:Ce; $Tb_3Al_{15}O_{12}$:Ce ZnS:Au,Cu; Al; ZnS:Cu; Al, $YBO_3$:Ce,Tb, and mixtures thereof.

Within the scope of this invention, non-limiting examples of phosphors which may be used for the generation of light in the red wavelength range are $Y(V,P)O_4$:Eu, $Y(V,P)O_4$:Dy, $Y(V,P)O_4$:In, MgFGe, $Y_2O_2S$:Eu, $(Sr,Mg,Zn)_3(PO_4)_2$:Sn, and mixtures thereof.

In one aspect of the present invention, the radiation source is provided with a means for generating and maintaining a gas discharge. In an embodiment, the means for generating and maintaining a discharge are electrodes disposed at two points of a radiation source housing or envelope and a voltage source providing a voltage to the electrodes. In one aspect of this invention, the electrodes are hermetically sealed within the housing. In another aspect, the radiation source is electrodeless. In another embodiment of an electrodeless radiation source, the means for generating and maintaining a discharge is an emitter of radio frequency present outside or inside at least one envelope containing the ionizable composition.

In still another embodiment of the present invention, the ionizable composition is capacitively excited with a high frequency field, the electrodes being provided on the outside of the gas discharge vessel. In still another embodiment of the present invention, the ionizable composition is inductively excited using a high frequency field.

EXAMPLE 1

A cylindrical quartz discharge vessel, which is transparent to UV-A radiation, 14 inches in length and 1 inch in diameter, was provided. The discharge vessel was evacuated and a dose of 10.3 mg of Zn and an amount of argon were added at ambient temperature to attain an internal pressure of 267 Pa. The vessel was inserted into a furnace and power was capacitively-coupled into the gas medium via external copper electrodes at an excitation frequency of 13.56 MHz. Radiative emission and radiant efficiency were measured. The ultraviolet output power was estimated to be about 55 percent of the input electrical power at about 390° C. When the ultraviolet radiation is converted to visible light by a suitable phosphor blend, the luminous efficacy was estimated to be 100 lm/W.

EXAMPLE 2

A cylindrical quartz discharge vessel, which is transparent to UV-A radiation, 14 inches in length and 1 inch in diameter, was provided. The discharge vessel was evacuated and a dose of 3.4 mg Zn and 5.6 mg $ZnI_2$ and argon were added. The pressure of argon was about 267 Pa. The vessel was inserted into a furnace and power was capacitively-coupled into the gas medium via external copper electrodes at an excitation frequency of 13.56 MHz. Radiative emission and radiant efficiency were measured. A luminous efficacy was estimated to be 100 lm/W at an operating temperature of about 255° C. with the use of a similar procedure as in Example 1.

The present invention also includes other embodiments that include zinc halides and an inert gas, such as argon, as the discharge medium. In particular, zinc bromide or zinc iodide is advantageously used.

While various embodiments are described herein, it will be appreciated from the specification that various combinations of elements, variations, equivalents, or improvements therein are foreseeable, may be made by those skilled in the art, and are still within the scope of the invention as defined in the appended claims.

The invention claimed is:

1. A radiation source comprising an ionizable mercury-free composition that comprises zinc and at least one zinc compound, wherein said at least one zinc compound is selected from the group consisting of halides, oxide, chalcogenides, hydroxide, hydride, organometallic compounds, and combinations thereof, wherein a majority of radiation emission originates from neutral zinc atoms.

2. The radiation source of claim 1, wherein the radiation source further comprises an inert buffer gas.

3. The radiation source of claim 2, wherein said inert buffer gas comprises a material selected from the group consisting of helium, neon, argon, krypton, xenon, and combinations thereof.

4. The radiation source of claim 2, wherein said inert buffer gas comprises argon.

5. The radiation source of claim 2, wherein said inert buffer gas has a pressure in a range from about 1 Pa to about $1\times10^4$ Pa during an operation of said radiation source.

6. The radiation source of claim 2, wherein said inert buffer gas has a pressure in a range from about 100 Pa to about $1\times10^3$ Pa during an operation of said radiation source.

7. The radiation source of claim 1, wherein said at least one zinc compound is a zinc halide.

8. The radiation source of claim 7, wherein said zinc halide is zinc iodide.

9. The radiation source of claim 7, wherein said zinc halide is zinc bromide.

10. The radiation source of claim 1, wherein the composition comprises at least two zinc compounds.

11. The radiation source of claim 1, wherein the zinc is present as a component of an alloy with at least another metal.

12. The radiation source of claim 1, wherein the radiation source further comprises a housing containing said composition; said housing comprises at least one envelope.

13. The radiation source of claim 12, further comprises a phosphor coating applied to the inner surface of said at least one envelope.

14. The radiation source of claim 12, further comprises a phosphor coating applied to the outer surface of said at least one envelope.

15. The radiation source of claim 12, wherein the housing comprises an inner envelope and an outer envelope.

16. The radiation source of claim 12 further comprising electrodes disposed in said housing.

17. The radiation source of claim 16 further comprising a voltage supply for applying a voltage to the electrodes.

18. The radiation source of claim 1, wherein the radiation source is provided with a means for generating and maintaining a gas discharge.

19. The radiation source of claim 18, wherein a gas discharge in said radiation source is initiated with a current flow through said means.

20. The radiation source of claim 18, wherein a gas discharge in said radiation source is initiated with a radio frequency.

* * * * *